US006367878B1

(12) United States Patent
Chung

(10) Patent No.: US 6,367,878 B1
(45) Date of Patent: Apr. 9, 2002

(54) ARMREST WITH OAK VENEER LAYER

(76) Inventor: Pei-Chiang Chung, No. 10, Lane 360, Shin-Hwa 1st Rd., Tan-Tzu Hsiang, Taichung Hsien (TW)

( * ) Notice: Subject to any disclaimer, the term of this patent is extended or adjusted under 35 U.S.C. 154(b) by 0 days.

(21) Appl. No.: 09/862,780

(22) Filed: May 21, 2001

(51) Int. Cl.[7] ..... A47C 7/54
(52) U.S. Cl. ..... 297/411.2; 297/411.46
(58) Field of Search ..... 297/411.2, 411.21, 297/411.46, 411.22; 248/345.1

(56) References Cited

U.S. PATENT DOCUMENTS 4,089,497 A * 5/1978 Miller et al. ..... 248/345.1
5,288,131 A * 2/1994 Singley ..... 297/452.24
5,924,769 A * 7/1999 Kao ..... 297/411.44
6,103,333 A * 8/2000 Keith ..... 428/99

* cited by examiner

*Primary Examiner*—Anthony D. Barfield
*Assistant Examiner*—Stephanie N. Harris
(74) *Attorney, Agent, or Firm*—Trop, Pruner & Hu, P.C.

(57) ABSTRACT

An armrest includes an armrest body, a veneer layer, and a pair of elongate decorative ribs. The armrest body is made of a wood material different from oak wood, extends in a longitudinal direction, and has lower, upper and opposing lateral surfaces. Each of the lateral surfaces is formed with a groove, planar and curved surface sections. The veneer layer is made of oak wood, and includes upper and lower veneer portions. The upper and lower veneer portions are fixedly attached to and cover the upper and lateral surfaces of the armrest body. Each of the decorative ribs is made of oak wood, extends in the longitudinal direction, and has a mounting section fixed in one of the grooves, and a protruding section protruding from the veneer layer.

4 Claims, 4 Drawing Sheets

ARMREST WITH OAK VENEER LAYER

BACKGROUND OF THE INVENTION

1. Field of the Invention

The invention relates to an armrest, more particularly to an armrest that has upper and lateral surfaces wholly covered by oak wood.

2. Description of the Related Art

Referring to FIG. 1, a conventional armrest 1 is shown to comprise an armrest body 10 that extends in a longitudinal direction, and that is formed with a lower surface 101, an upper surface 102, and opposing lateral surfaces 103 that interconnect the lower and upper surfaces 101, 102. Each of the lateral surfaces 103 is formed with a protruding rib 104 that extends in the longitudinal direction, a planar surface section 105 that extends from the lower surface 101 to a lower edge 104' of the rib 104, and a curved surface section 106 that extends from an upper edge 104" of the rib 104 to the upper surface 102.

The wood material commonly used for the conventional armrest 1 is oak wood because oak wood has high density, is tough and durable, and has uniform grain. However, the processing of the conventional armrest 1 using the multi-faceted wood planing machine results in a severe wastage of oak wood material.

Referring to FIG. 2, an armrest 2 with an oak veneer layer has been proposed heretofore to overcome the aforesaid drawback. The armrest 2 comprises an armrest body 20 that extends in a longitudinal direction, and a veneer layer 30. The armrest body 20 is made of a wood material different from oak wood, such as pine wood, red wood, and cedar wood, and has a lower surface 201, an upper surface 202, and opposing lateral surfaces 203 that interconnect the lower and upper surfaces 201, 202. Each of the lateral surfaces 203 is formed with a protruding rib 204 that extends in the longitudinal direction, a planar surface section 205 that extends from the lower surface 201 to a lower edge 204' of the rib 204, and a curved surface section 206 that extends from an upper edge 204" of the rib 204 to the upper surface 202. The veneer layer 30 is made of oak wood, and is fixedly attached to and covers the upper surface 202 and the curved surface sections 206 of the lateral surfaces 203 of the armrest body 20.

The armrest 2 has a relatively low oak wood material requirement. However, the planar surface sections 205 of the lateral surfaces 206 of the armrest body 20 are unable to be covered by the veneer layer 30 because of the protruding ribs 204.

SUMMARY OF THE INVENTION

Therefore, the main object of the present invention is to provide an armrest that has upper and lateral surfaces wholly covered by oak wood.

Accordingly, an armrest of this invention comprises an armrest body, a veneer layer, and a pair of elongate decorative ribs. The armrest body is made of a wood material different from oak wood, extends in a longitudinal direction, and has a lower surface, an upper surface and opposing lateral surfaces that interconnect the lower and upper surfaces. Each of the lateral surfaces is formed with a groove that extends in the longitudinal direction and that has lower and upper groove edges, a planar surface section that extends from the lower surface to the lower groove edge, and a curved surface section that extends from the upper groove edge to the upper surface. The veneer layer is made of oak wood, and includes an upper veneer portion and a pair of lower veneer portions. The upper veneer portion is fixedly attached to and covers the upper surface and the curved surface sections of the lateral surfaces of the armrest body. The lower veneer portions are fixedly attached to and cover respectively the planar surface sections of the lateral surfaces of the armrest body. Each of the elongate ribs is made of oak wood, extends in the longitudinal direction, and has mounting and protruding sections. The mounting section is fixed in the groove of a respective one of the lateral surfaces of the armrest body. The protruding section is connected to the mounting section and protrudes from the veneer layer.

BRIEF DESCRIPTION OF THE DRAWINGS

Other features and advantages of the present invention will become apparent in the following detailed description of the preferred embodiment with reference to the accompanying drawings, of which.

DETAILED DESCRIPTION OF THE PREFERRED EMBODIMENT

Figure 2:
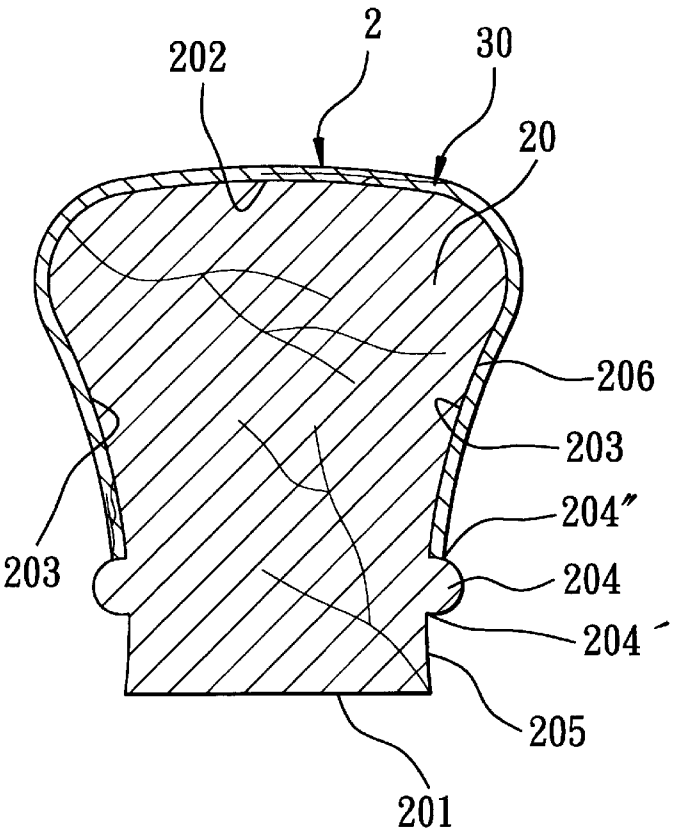
FIG. 2 PRIOR ART
FIG. 2 is a sectional view of another conventional armrest.
Figure 1:
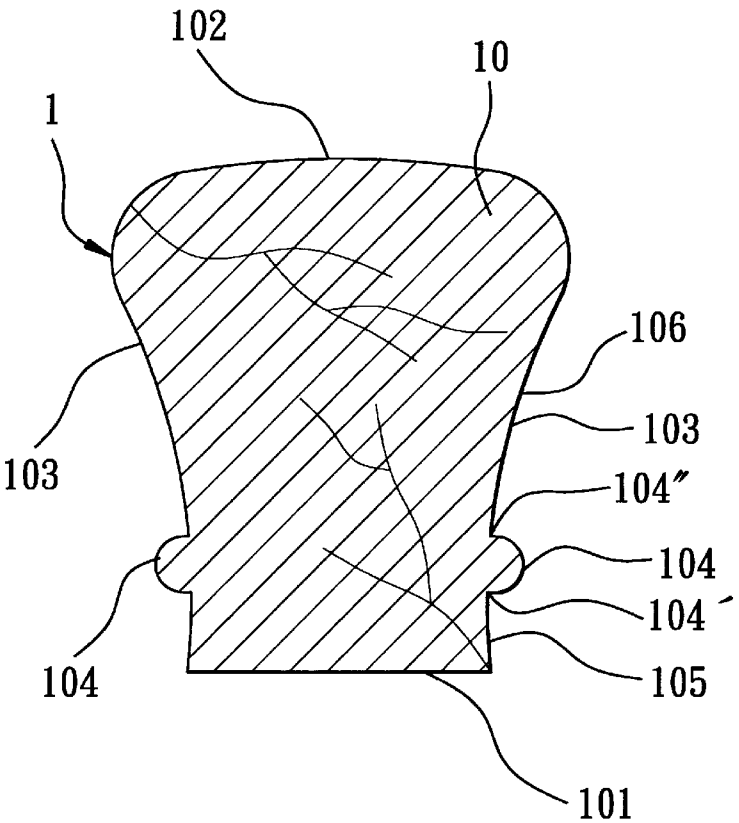
FIG. 1 PRIOR ART
FIG. 1 is a sectional view of a conventional armrest.
Figure 3:
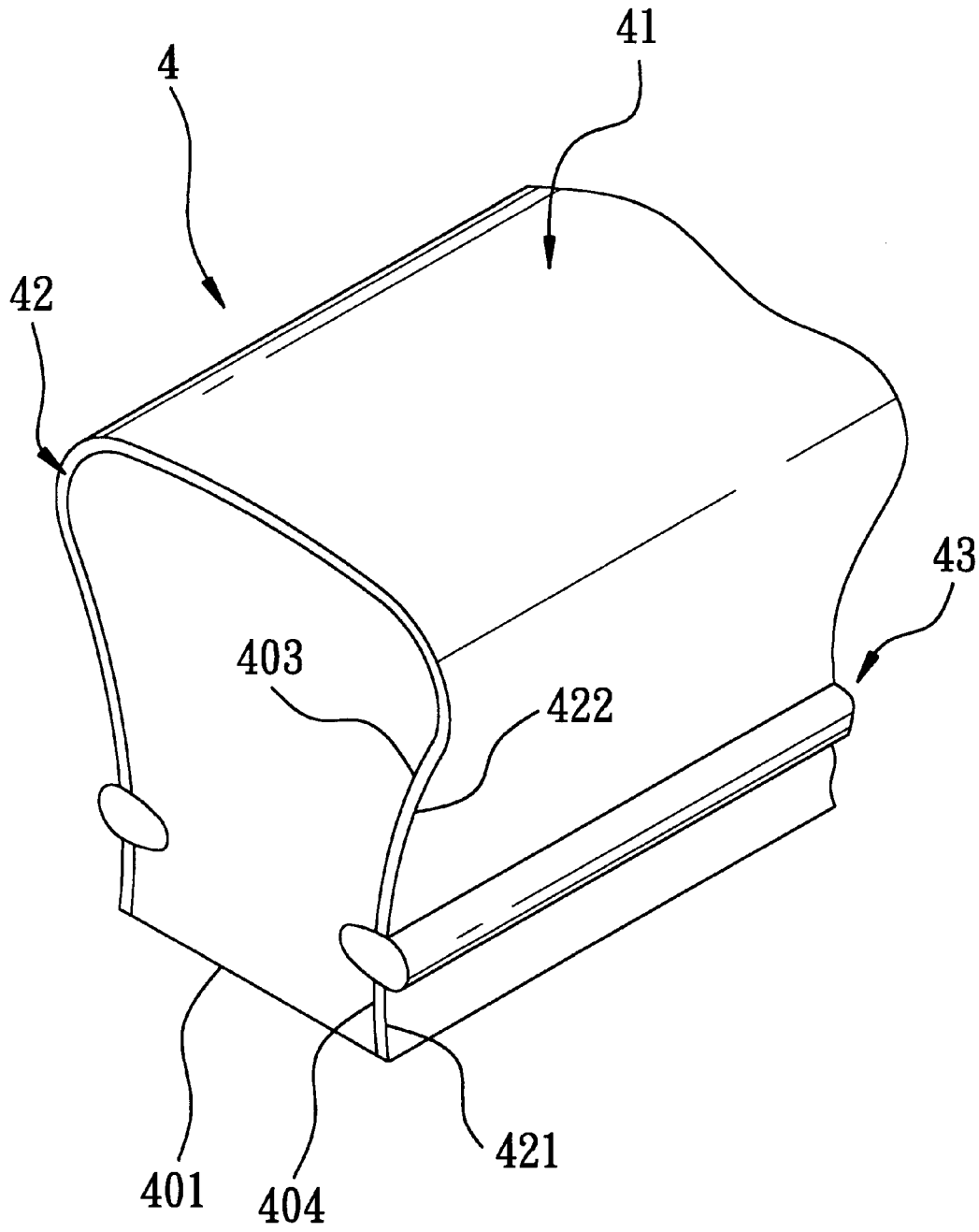
FIG. 3 is a perspective view of the preferred embodiment of an armrest according to the present invention.
Figure 4:
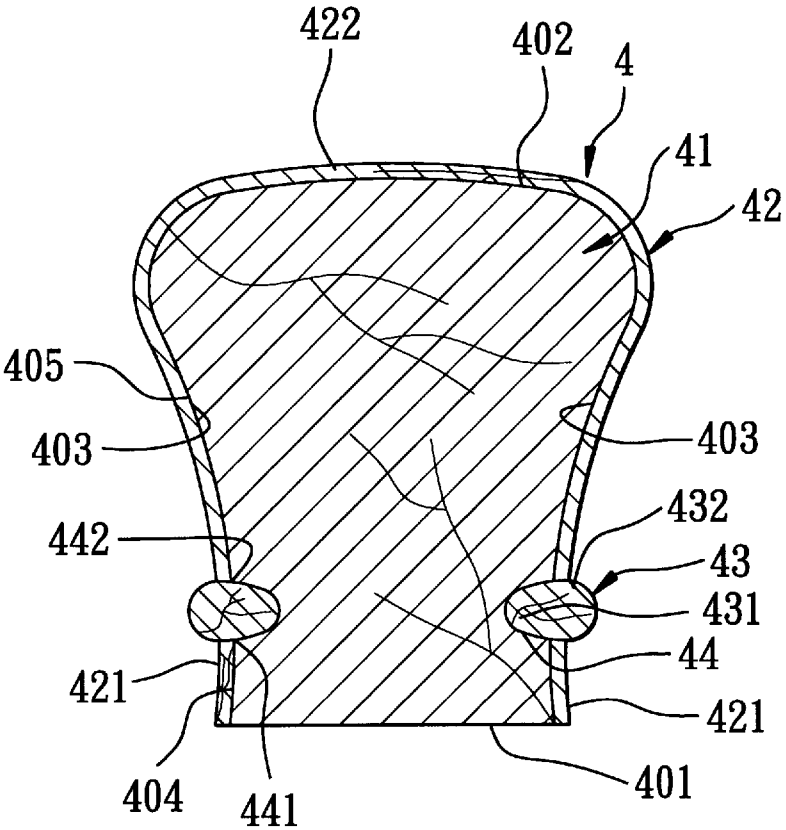
FIG. 4 is a sectional view of the armrest of FIG. 3.

Referring to FIGS. 3 and 4, the first preferred embodiment of an armrest 4 according to the present invention is shown to comprise an armrest body 41, a veneer layer 42, and a pair of elongate decorative ribs 43. The armrest body 41 is made of a wood material different from oak wood, such as pine wood, red wood, cedar wood and rubber wood, extends in a longitudinal direction, and has a lower surface 401, an upper surface 402 and opposing lateral surfaces 403 that interconnect the lower and upper surfaces 401, 402. Each of the lateral surfaces 403 is formed with a groove 44 that extends in the longitudinal direction and that has lower and upper groove edges 441, 442, a planar surface section 404 that extends from the lower surface 401 to the lower groove edge 441, and a curved surface section 405 that extends from the upper groove edge 442 to the upper surface 402.

The veneer layer 42 is made of oak wood, and includes an upper veneer portion 422 and a pair of lower veneer portions 421. The upper veneer portion 422 is fixedly attached to and covers the upper surface 402 and the curved surface sections 405 of the lateral surfaces 403 of the armrest body 41. The lower veneer portions 421 are fixedly attached to and cover respectively the planar surface sections 404 of the lateral surfaces 403 of the armrest body 41.

Each of the decorative ribs 43 is made of oak wood, extends in the longitudinal direction, and has mounting and protruding sections 431, 432. The mounting section 431 is fixed in the groove 44 of a respective one of the lateral surfaces 403 of the armrest body 41 by means of an adhesive. The protruding section 432 is connected to the mounting section 431 and protrudes from the veneer layer 42.

The upper and lateral surfaces of the armrest 4 according to this invention are wholly covered by oak wood.

Preferably, the wood material for the armrest 4 is rubber wood, which is readily available and is relatively inexpensive. In addition, each of the decorative ribs 43 has a teardrop cross-section and tapers in a direction from the protruding section 432 to the mounting section 431.

Figure 5:
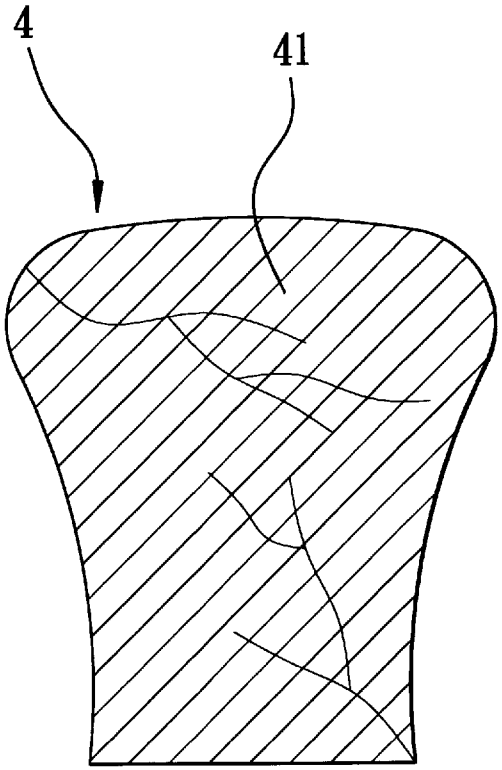
FIGS. 5, 6 and 7 are sectional views illustrating consecutive steps of a process for producing the armrest of FIG. 3 in accordance with the present invention.
Figure 7:
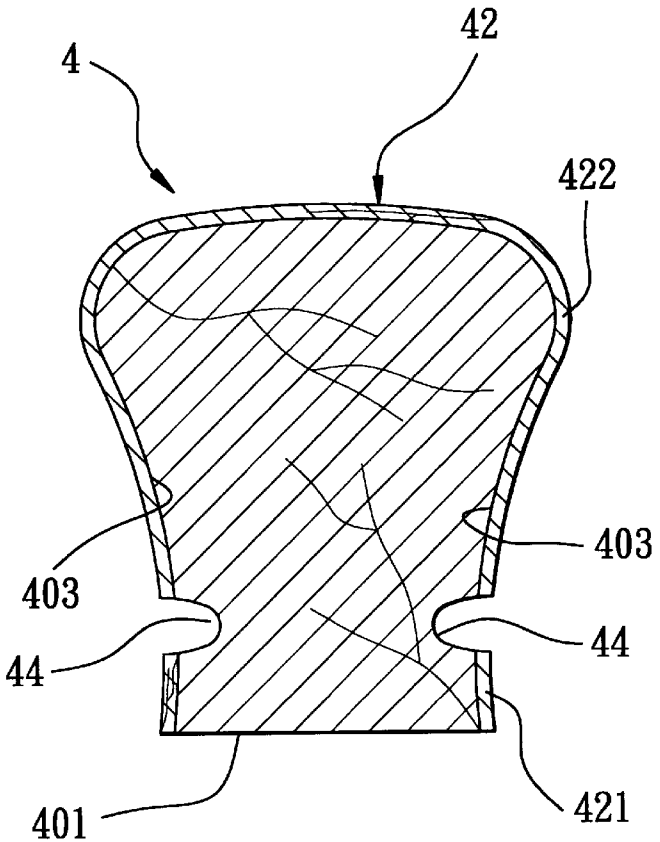
Figure 6:
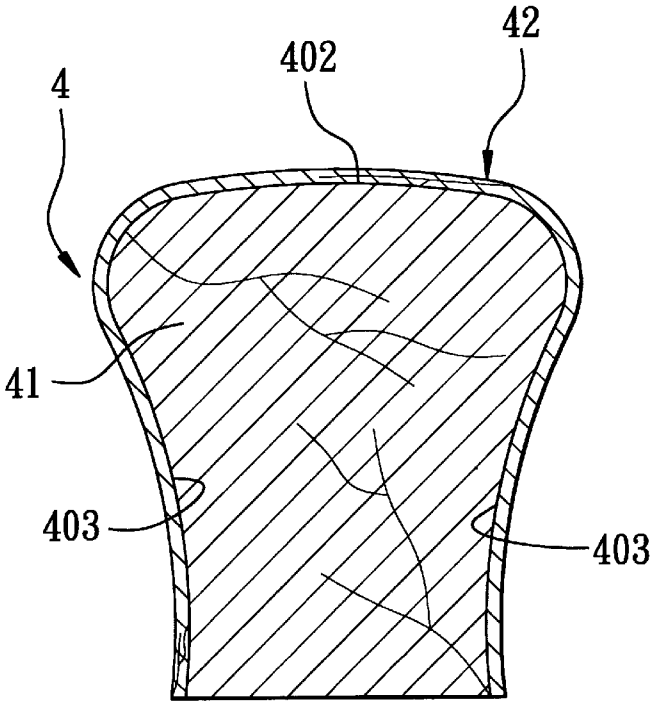

The process for producing the armrest 4 of the present invention is best illustrated with reference to FIGS. 5 to 7. In FIG. 5, the armrest body 41 is contoured without forming the grooves 44. Then, as shown in FIG. 6, the veneer layer 42 is fixedly attached to and covers the upper and lateral surfaces 402, 403 of the armrest body 41. Subsequently, as shown in FIG. 7, the grooves 44 are cut in the veneer layer 42 and in the lateral surfaces 403 of the armrest body 41 with the use of a lathe machine, thereby forming the planar and curved surface sections 404, 405 on the lateral surfaces 403, and the upper and lower veneer portions 422, 421 of the veneer layer 42. Finally, as shown in FIG. 4, the decorative ribs 43 are bonded adhesively in the grooves 44 of the lateral surfaces 403 of the armrest body 41.

While the present invention has been described in connection with what is considered the most practical and preferred embodiment, it is understood that this invention is not limited to the disclosed embodiment but is intended to cover various arrangements included within the spirit and scope of the broadest interpretation so as to encompass all such modifications and equivalent arrangements.

I claim:

1. An armrest comprising:

an armrest body made of a wood material different from oak wood, said armrest body extending in a longitudinal direction and having a lower surface, an upper surface and opposing lateral surfaces that interconnect said lower and upper surfaces, each of said lateral surfaces being formed with a groove that extends in the longitudinal direction and that has lower and upper groove edges, a planar surface section that extends from said lower surface to said lower groove edge, and a curved surface section that extends from said upper groove edge to said upper surface;

a veneer layer made of oak wood and including an upper veneer portion and a pair of lower veneer portions, said upper veneer portion being fixedly attached to and covering said upper surface and said curved surface sections of said lateral surfaces of said armrest body, said lower veneer portions being fixedly attached to and covering respectively said planar surface sections of said lateral surfaces of said armrest body; and a pair of elongate decorative ribs, each of which is made of oak wood, extends in the longitudinal direction, and has a mounting section fixed in said groove of a respective one of said lateral surfaces of said armrest body, and a protruding section connected to said mounting section and protruding from said veneer layer.

2. The armrest of claim 1, wherein each of said decorative ribs tapers in a direction from said protruding section to said mounting section.

3. The armrest of claim 1, wherein the wood material is selected from pine wood, red wood, cedar wood and rubber wood.

4. The armrest of claim 1, wherein the wood material is rubber wood.

* * * * *